US010220588B2

(12) United States Patent
Wiley

(10) Patent No.: US 10,220,588 B2
(45) Date of Patent: Mar. 5, 2019

(54) INSTANT SET-UP BULK CONTAINER

(71) Applicant: Ted E. Wiley, Dover, AR (US)

(72) Inventor: Ted E. Wiley, Dover, AR (US)

(73) Assignee: Innovative Design Concepts, Inc., Dover, AR (US)

( * ) Notice: Subject to any disclaimer, the term of this patent is extended or adjusted under 35 U.S.C. 154(b) by 0 days.

(21) Appl. No.: 15/818,059

(22) Filed: Nov. 20, 2017

(65) Prior Publication Data

US 2018/0072012 A1 Mar. 15, 2018

Related U.S. Application Data

(63) Continuation of application No. 15/046,261, filed on Feb. 17, 2016, now Pat. No. 9,827,732.
(Continued)

(51) Int. Cl.
*B65D 5/36* (2006.01)
*B31B 50/46* (2017.01)
(Continued)

(52) U.S. Cl.
CPC ..... *B31B 50/46* (2017.08); *B31B 50/14* (2017.08); *B65D 5/3614* (2013.01);
(Continued)

(58) Field of Classification Search
CPC ..... B65D 5/3607; B65D 5/4279; B31B 5/14; B31B 2203/003
(Continued)

(56) References Cited

U.S. PATENT DOCUMENTS 1,796,035 A 3/1931 Maier
2,019,787 A 11/1935 Leopold
(Continued)

FOREIGN PATENT DOCUMENTS

CH 2861027 Y 1/2007
CH 103448979 12/2013
(Continued)

OTHER PUBLICATIONS

Unknown, 5lb. Mushroom Container.
(Continued)

*Primary Examiner* — Christopher Demeree
(74) *Attorney, Agent, or Firm* — Kutak Rock LLP; Sara Weilert Gillette

(57) ABSTRACT

A foldable container moveable between a stowed configuration and a deployed configuration defining an interior area for holding bulk material is provided. The container includes opposed side panels and a bottom flap extending from a bottom edge of each side panel. A tab member extends from a distal end of each bottom flap and a tab finger extends from each tab member so as to define a hook at a distal end of each bottom flap. The hooks are interconnected so as to hingedly connect the distal ends of the bottom flaps together, thereby causing the bottom flaps to rotate between their respective stowed and deployed configuration positions as the end panels are translated between their respective stowed and deployed configuration positions. Locking tabs extending from distal ends of end flaps extend into the interior area of the container to secure the container in the deployed configuration.

18 Claims, 18 Drawing Sheets

Related U.S. Application Data

(60) Provisional application No. 62/117,015, filed on Mar. 11, 2015, provisional application No. 62/119,627, filed on Feb. 23, 2015.

(51) Int. Cl.
*B31B 50/14* (2017.01)
*B31B 100/00* (2017.01)
*B31B 120/30* (2017.01)

(52) U.S. Cl.
CPC ... *B31B 2100/00* (2017.08); *B31B 2100/0022* (2017.08); *B31B 2120/30* (2017.08); *B65D 2585/649* (2013.01)

(58) Field of Classification Search
USPC ..... 229/108–110, 117, 117.01, 117.03; 206/171
See application file for complete search history.

(56) References Cited

U.S. PATENT DOCUMENTS

| | | | | |
|---|---|---|---|---|
| 2,459,939 | A | 1/1949 | Hill | |
| 2,660,363 | A | 11/1953 | Trickett, Jr. | |
| 3,039,600 | A | 6/1962 | Bellows | |
| 3,381,880 | A | 5/1968 | Carle et al. | |
| 4,171,763 | A | 10/1979 | Card | |
| 4,238,069 | A | 12/1980 | Morris, Jr. | |
| 4,365,738 | A | 12/1982 | Densen | |
| 4,392,607 | A | 7/1983 | Perkins, Jr. | |
| 4,676,429 | A | 6/1987 | Crowe | |
| 4,702,408 | A * | 10/1987 | Powlenko | B65D 5/10 229/101 |
| 4,844,331 | A | 7/1989 | Oldfather | |
| 4,856,705 | A | 8/1989 | Carr et al. | |
| 5,016,814 | A | 5/1991 | Fullerton | |
| 5,139,196 | A * | 8/1992 | Fry | B65D 5/10 229/109 |
| 5,398,868 | A | 3/1995 | Densen | |
| D361,892 | S | 9/1995 | Quaintance | |
| 5,531,374 | A | 7/1996 | Gasper | |
| 5,630,543 | A | 5/1997 | Dugan | |
| 5,853,121 | A | 12/1998 | Francisco | |
| 5,915,617 | A | 6/1999 | Gasper | |
| 7,328,833 | B1 | 2/2008 | Wiley | |
| 7,654,440 | B2 * | 2/2010 | Quaintance | B65D 5/029 229/109 |
| 9,045,250 | B2 | 6/2015 | Henderson et al. | |
| 2004/0211825 | A1 * | 10/2004 | Champion | B65D 5/3621 229/178 |
| 2008/0078819 | A1 * | 4/2008 | Strong | B65D 5/029 229/109 |
| 2009/0057382 | A1 | 3/2009 | Churvis | |
| 2009/0121001 | A1 | 5/2009 | Perez et al. | |

FOREIGN PATENT DOCUMENTS

| | | |
|---|---|---|
| FR | 2995286 | 3/2014 |
| WO | 9807629 | 2/1998 |

OTHER PUBLICATIONS

International Search Report for PCT/US2014/036014 dated Sep. 24, 2014.
Written Opinion for PCT/US2014/036014 dated Sep. 24, 2014.

* cited by examiner

INSTANT SET-UP BULK CONTAINER

CROSS REFERENCES

This application is a continuation application of co-pending U.S. patent application Ser. No. 15/046,261, filed Feb. 17, 2016, which claims priority pursuant to 35 U.S.C. 119(e) to U.S. Provisional Patent Application Ser. Nos. 62/117,015 and 62/119,627, the entire disclosures of which are herein incorporated by reference.

FIELD OF THE INVENTION

The present invention relates generally to foldable containers. More specifically, the present invention is concerned with foldable bulk containers.

BACKGROUND

Foldable containers are commonly used to store and/or ship various products. Foldable containers provide benefits over non-foldable containers at least because foldable containers can be folded from a flat configuration into a three-dimensional configuration.

It is much easier to ship and store containers when they are in relatively flat in a "stowed" configuration. Consequently, containers are usually not moved from their stowed configurations into their three-dimensional "deployed" configurations until they are needed. This often results in the containers being assembled by personnel that may or may not be familiar with the process of folding a particular container. Consequently, it would be beneficial for the container to be designed such that it is relatively easy to move the container from a stowed configuration into a deployed configuration.

Once the container is folded into a deployed configuration, users are often required to apply tape or some other adhesive to hold the container in the deployed configuration. Often, however, such adhesive is damaging to the container and/or inappropriate for the particular application. Consequently, it would be beneficial if the container included one or more feature for securing the container in the deployed configuration without requiring the use of adhesives. Furthermore, some containers, especially large bulk containers, require reinforcing straps. If a user forgets to install the strap and/or installs the strap incorrectly, the container can break. Consequently, it would be beneficial if the container was configured such that it did not require a reinforcing strap.

Many large bulk containers require two people to assemble the container. Consequently, it would be beneficial if large bulk containers could be safely assembled by a single person.

A bulk container is a specific type of container that is particularly well-suited for holding a large volume of items, material, or the like ("bulk material"). Such containers are often fabricated from one or more piece of flat material that is folded into a three-dimensional container having a plurality of vertical panels extending upwards from a bottom panel so as to define an interior area for holding the product. In many cases, the container is placed on a pallet so that the product can be moved without requiring the bottom panel to be sturdy enough to hold the entire weight of the product. While providing a relatively continuous barrier by itself, the various cuts and folds forming the bottom of the container create gaps and holes through which bulk material can escape from the interior area of the container and/or through which foreign objects can migrate into the interior area, potentially contaminating the bulk material. In some embodiments, an additional piece of material is required to cover and/or otherwise seal these gaps and holes. Unfortunately, such extra piece of material can be misplaced or forgotten. Furthermore, such extra pieces of material are not always sized appropriately for the container. Consequently, it would be beneficial if the various panels and/or flaps of the container included features for covering any gaps and/or holes so that a separate piece of material is not required.

SUMMARY

The present invention comprises a foldable container that is movable from a generally flat "stowed" configuration to a three-dimensional "deployed" configuration. While in the stowed configuration, various panels of the container are folded relatively flat with each other so that a plurality of containers can be stacked on top of each other for shipping and storage of the containers themselves. While in the deployed configuration, the container defines an interior area for holding items, material, or the like ("bulk material").

Some embodiments of the container of the present invention are stronger than existing bulk containers. For instance, in some embodiments and for some applications, reinforcement straps that are required for existing bulk containers are not required for the bulk container of the present invention. Various embodiments of the present invention are also easier and faster to fabricate and erect than are existing bulk containers. For instance, some embodiments can be erected by one person in less time than it takes multiple people to erect existing bulk containers.

Embodiments of each container include various novel features to assist users in quickly and easily moving the container from the stowed configuration to the deployed configuration and/or for allowing a user to move the container from the stowed configuration back to the deployed configuration without adversely affecting the structural integrity of the container. In some embodiments, a key feature is opposed hooks extending from distal ends of opposed bottom flaps. The hooks are interlocked so as to hingedly couple the distal ends of the bottom flaps together. Each bottom flap extends from a bottom edge of a side panel of the container such that as the side panels are translated from their respective stowed configuration positions to their respective deployed configuration positions, the bottom flaps are simultaneously rotated from their respective stowed configuration positions to their respective deployed configuration positions. In some embodiments, the hooks and/or other locking features secure the bottom flaps together such that tape, adhesives, and other bonding agents are not required.

Some embodiments of the present invention further include locking tabs for further securing the container in the deployed configuration when the locking tabs are in a locked configuration. In some such embodiments, the locking tabs extend partially into the interior area of the container such that as bulk material is placed into the container, the weight of the bulk material secures the locking tab in the locked configuration. In other such embodiments, the locking tabs extend partially between a bottom surface of bottom panels and a top surface of a support structure (such as a floor or a pallet) such that the weight of the container and/or bulk material within the container secures the locking tab in the locked configuration. In still other embodiments, the locking tabs are moveable to an unlocked configuration so as to enable the container to be moved to the stowed configuration.

Some embodiments of the present invention further include corner flaps and/or auxiliary flaps for covering one or more hole or gap in the container. In this way, bulk material within the container is less likely to migrate out of the container and foreign objects outside of the container are less likely to migrate into the container.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
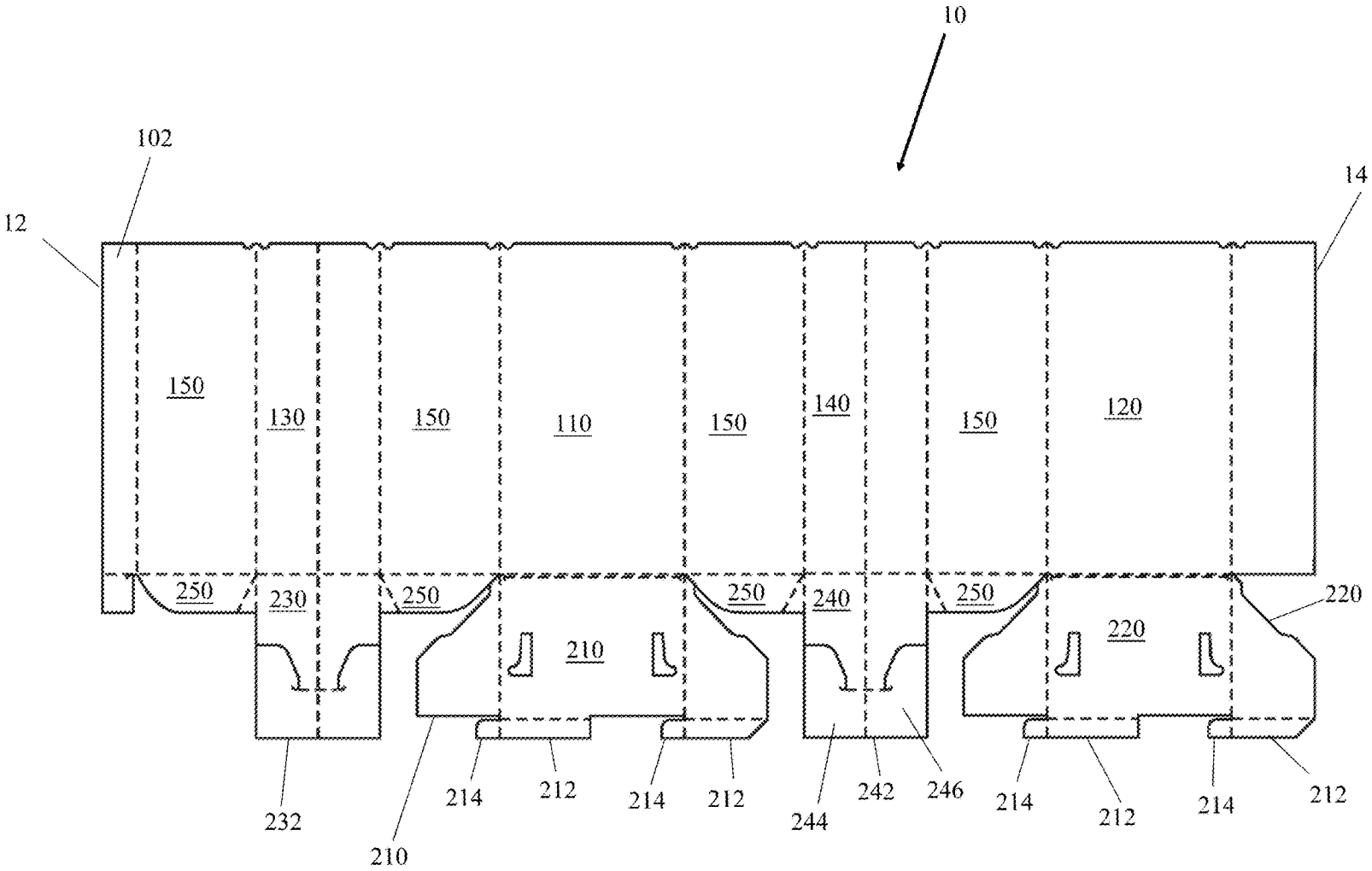
FIG. 1 is a plan view of a die cut and pre-creased and/or perforated flat piece of material in a pattern of a preferred embodiment of the present invention, the flat piece of material being configured so as to be selectively moveable to a three-dimensional container configuration.
Figure 2:
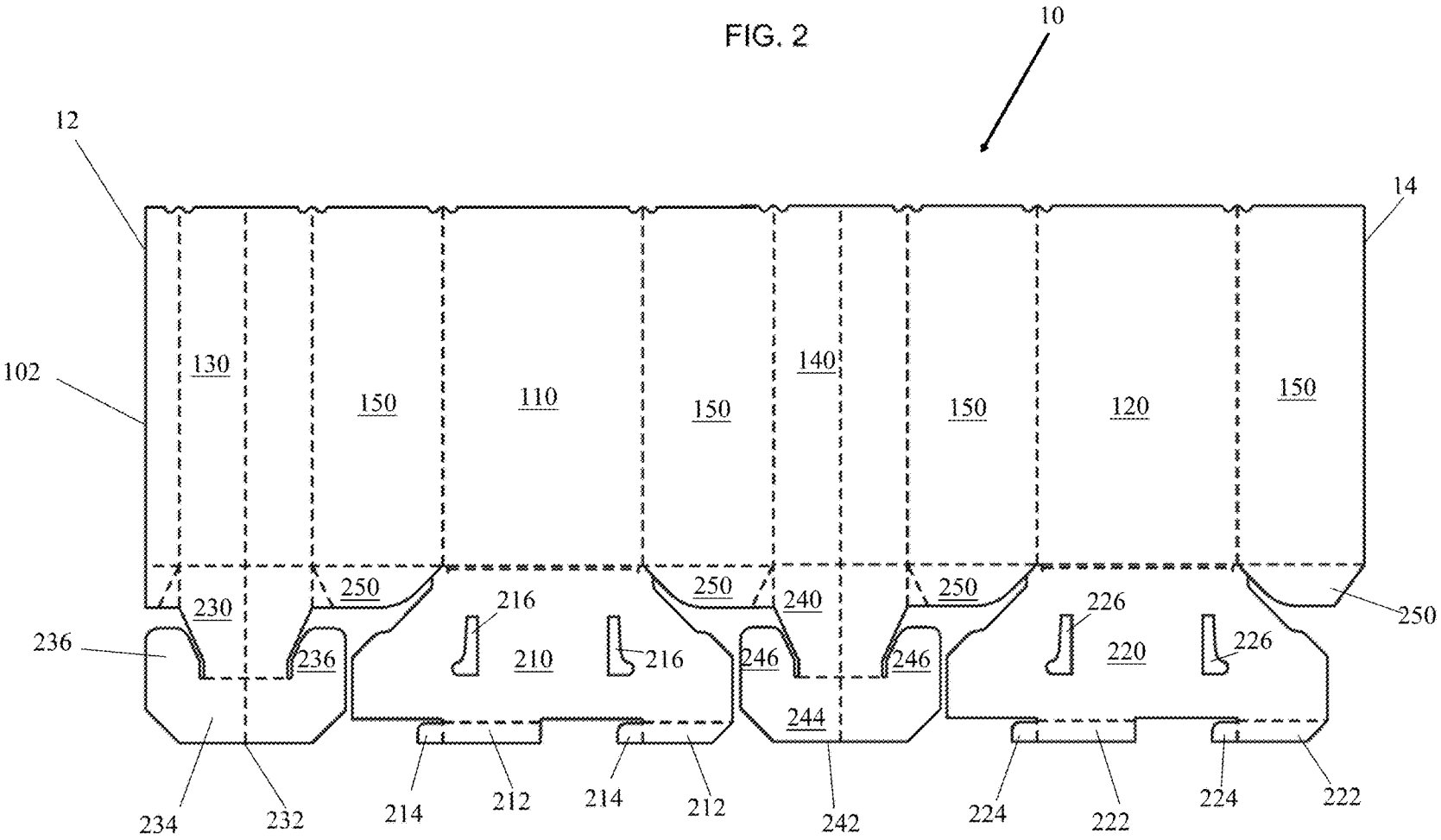
FIG. 2 is a plan view of a die cut and pre-creased and/or perforated flat piece of material in a pattern of a preferred embodiment of the present invention, the flat piece of material being configured so as to be selectively moveable to a three-dimensional container configuration.

Referring to FIGS. 1 and 2, a preferred embodiment of a flat pattern 10 of the present invention includes a plurality of vertical panels separated by fold lines and/or perforated lines. In some embodiments, a first end 12 of the flat pattern 10 includes a vertical flap 102 that is configured to secure (e.g. glue, tape, etc.) to a second end 14 of the flat pattern 10 such that when the flat pattern 10 is folded into a three-dimensional container, the plurality of vertical panels define a continuous vertical wall.

In a preferred embodiment of the present invention, the plurality of vertical panels include first 110 and second 120 side panels and first 130 and second 140 end panels. In some embodiments, the first 130 and second 140 end panels extend directly between the first 110 and second 120 side panels such that the container has a rectangular configuration. In other embodiments, corner panels 150 extend between each side panel 110, 120 and end panel 130, 140 such that the bulk container has an octagonal configuration. It will be appreciated that still other panel configurations are capable of being folded into containers having various other shapes.

In a preferred embodiment, first 210 and second 220 bottom flaps extend from a bottom edge of respective first 110 and second 120 side panels. In some embodiments, a first tab 212 extends from a distal end of the first bottom flap 210 and a second tab 222 extends from a distal end of the second bottom flap 220 such that when the bottom flaps 210, 220 are folded towards each other, each tab 212, 222 extends beyond the distal end of the opposing bottom flap. In some such embodiments, first 214 and second 224 tab fingers extend from respective first 212 and second 222 tabs so as to create at least one hook associated with each bottom flap. As the bottom flaps 210, 220 are folded towards each other, the first 214 and second 224 tab fingers/hooks are capable of being interlocked with each other, thereby hingedly coupling the distal end of the first bottom flap 210 to the distal end of the second bottom flap 220. In some embodiments, a plurality of tabs having tab fingers/hooks extend from each of the first 210 and second 220 bottom flaps such that a first set of hooks extends from the distal end of the first bottom flap and a second set of hooks extends from the distal end of the second bottom flap. In some such embodiments, each hook of the first set of hooks is capable of being interlocked with a hook of the second set of hooks, thereby providing additional structural support for coupling the distal ends of the first and second bottom flaps together.

The container is moveable between a stowed configuration and a deployed configuration. In a preferred embodiment, interlocked hooks remain interlocked as the container is moved between the stowed configuration and the deployed configuration and while the container is in the stowed configuration and the deployed configuration. In this way, the interlocked hooks decrease the time it takes to move the container between the stowed configuration and the deployed configuration and increases the strength and stability of the container when it is in the deployed configuration such that, in some embodiments, adhesives and straps are no longer required.

In the deployed configuration, the first 110 and second 120 side panels are displaced from each other and the first 210 and second 220 bottom flaps extend between the first and second side panels such that the container defines an interior area having a generally enclosed bottom and an open top. In this way, the container is optimized for storing and/or shipping a large volume of items, material, or the like.

In the stowed configuration, the first 210 and second 220 panels are folded against each other and the first and second side panels are positioned in general proximity to each other such that the container is relatively flat and occupies a relatively small volume. In this way, the container is optimized for storage and/or shipping of a plurality of containers.

In some embodiments, the bottom flaps are configured to fold down and away from the interior area of the container as the container is moved from the deployed configuration to the stowed configuration. In some such embodiments, the opposed side panels are positioned adjacent to each other when the container is in the stowed configuration. In other embodiments, the bottom flaps are configured to fold up and into the interior area of the container as the container is moved from the deployed configuration to the stowed configuration. In some such embodiments, each side panel is adjacent to its respective bottom flap and the bottom flaps are sandwiched between the opposed side panels when the container is in the stowed configuration.

In some embodiments, each end panel is bisected by a fold line such that when the container is in the stowed configuration each end panel is folded over against itself. In some such embodiments, unfolding the end panels causes the side panels to move away from each other. In embodiments having interconnected tab fingers/hooks, moving the side panels away from each other causes the bottom panels to rotate away from each other, thereby causing the container to move towards the deployed configuration. In the deployed configuration, each end panel is relatively flat and, in some embodiments, relatively parallel with the other end panel. In some such embodiments, each end panel is perpendicular with each side panel and the bottom flaps are generally perpendicular with the side panels and the end panels.

In a preferred embodiment, first 230 and second 240 end flaps extend from a bottom edge of respective first 130 and second 230 end panels. In some embodiments, each end flap is configured to fold against the first 210 and/or second 220 bottom flaps when the bulk container is in the deployed configuration.

In some embodiments, a first locking tab 232 extends from a distal end of the first end flap 230 and a second locking tab 242 extends from a distal end of the second end flap 240. In some such embodiments, each locking tab is moveable between a locked configuration and an unlocked configuration. In some embodiments, the locking tab is approximately parallel with its respective end flap and/or extends generally towards the opposed end flap when the locking tab is in the locked configuration. In other embodiments, the locking tab is approximately perpendicular to its respective end flap when the locking tab is in the unlocked configuration.

In some embodiments, each locking tab 232, 242 includes a handle portion 234, 244 and locking tab fingers 236, 246 extending from respective handle portions 234, 244. In some such embodiments, each handle portion extends generally away from its respective end flap towards the opposing end flap. In other such embodiments, each locking tab finger extends generally away from its respective handle portion towards its respective end panel.

In some embodiments, each locking tab is coupled to its respective end flap at a hinge line and is configured such that as its handle portion is rotated down and away from an end flap plane defined by its respective end flap, its locking tab fingers rotate up and away from the end flap plane. In this way, movement of the handle portion is capable of moving the entire locking tab between the locked and unlocked configurations. In some such embodiments, the locking tab fingers are approximately on the same plane as the handle portion while the locking tab is in the locked configuration, the unlocked configuration, and throughout the movement between the locked and unlocked configuration.

In some embodiments, a proximal end of the handle portion of the locking tab is hingedly coupled to a distal end of the end flap. In some such embodiments, the proximal end of the handle portion of the locking tab is wider than the distal end of the end flap such that locking tab fingers extending from the proximal end of the handle portion are positioned relatively adjacent to the end flap on opposed sides of the end flap.

In some embodiments, the bottom flaps 210, 220 each define locking slots 216, 226 that are configured to receive the locking tab fingers 236, 246 of the locking tab when the container is in the deployed configuration. In some such embodiments, the locking tab fingers and the locking slots are configured such that when the locking tab fingers are received by the locking slots and the locking tabs are in the locked configuration, the end flaps are inhibited and/or prevented from rotating away from the bottom flaps and/or the container's ability to expand when horizontal loads are imposed on the vertical panels is inhibited and/or prevented. In other such embodiments, the locking tab fingers are configured such that when the locking tab is moved to the unlocked configuration the end flaps are allowed to fold away from the bottom flaps, thereby enabling the locking tab fingers of the locking tab to be removed from the locking tab slots of the bottom flaps. In some such embodiments, folding the end flap towards the bottom flaps while the locking tab is in the unlocked configuration allows the locking tab fingers of the locking tab to be received by the locking slots of the bottom flaps.

In some embodiments, the locking slots 216, 226 of the bottom panels each define an "L"-shape. In some such embodiments, a primary slot portion is positioned, oriented, sized, and/or otherwise configured to receive the locking tab fingers of the locking tab. In other such embodiments, a secondary slot portion is positioned, oriented, sized, and/or otherwise configured to accommodate the locking tab rotating to the locked configuration while minimizing bending and/or otherwise reducing deflection of the locking tab fingers.

In some embodiments, the locking tab fingers extend into the interior area of the container such that as bulk material is placed into the interior area of the container, the weight of the bulk material pushes the locking tab fingers down towards the bottom flaps, thereby securing the locking tabs in the locked configuration. In other embodiments, the handle portions of the locking tabs are positioned outside of the interior area and are sandwiched between a top surface of a support structure (such as the floor or a pallet) and a bottom surface of the bottom flaps such that the weight of the container inhibits the locking tabs' ability to move away from the locked configuration. As weight is added to the container, the locking tabs are further secured in the locked configuration.

In some embodiments of the present invention, corner flaps 250 extend from bottom edges of the corner panels 150. In some embodiments, the corner flaps fold up and against the bottom flaps as the end flaps are folded up and against the bottom flaps. In some such embodiments, the corner flaps and the bottom flaps are retained against the bottom flaps while the locking tabs are in the locked configuration. In this way, the corner flaps are capable of providing additional vertical support to the bottom flaps and/or reducing and/or eliminating gaps between the various flaps and/or panels, thereby reducing the chance that bulk material will be lost out of the bottom of the container and/or foreign objects will migrate into the container.

Figure 3:
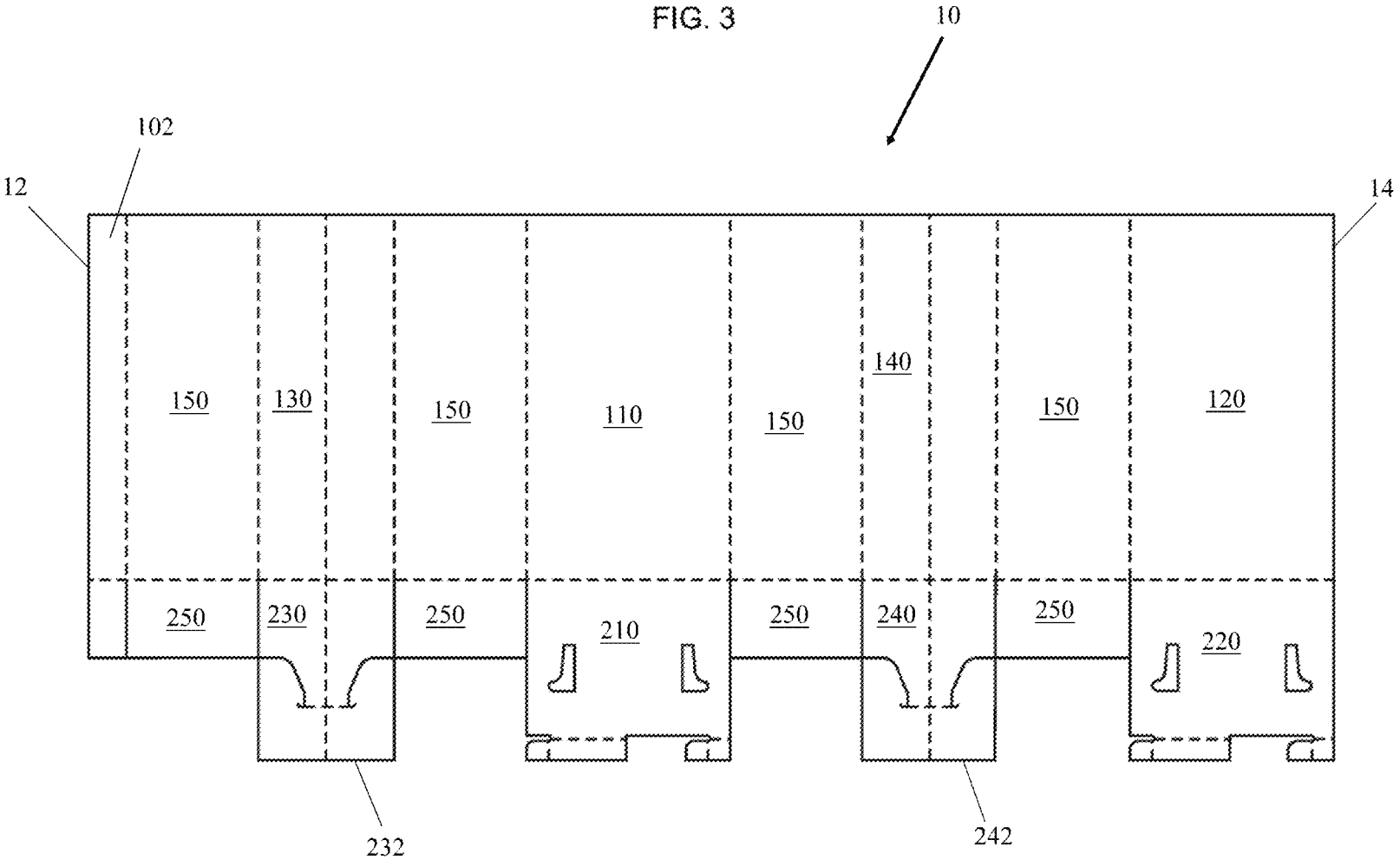
FIG. 3 is a plan view of a die cut and pre-creased and/or perforated flat piece of material in a pattern of a preferred embodiment of the present invention, the flat piece of material being configured so as to be selectively moveable to a three-dimensional container configuration.
Figure 5:
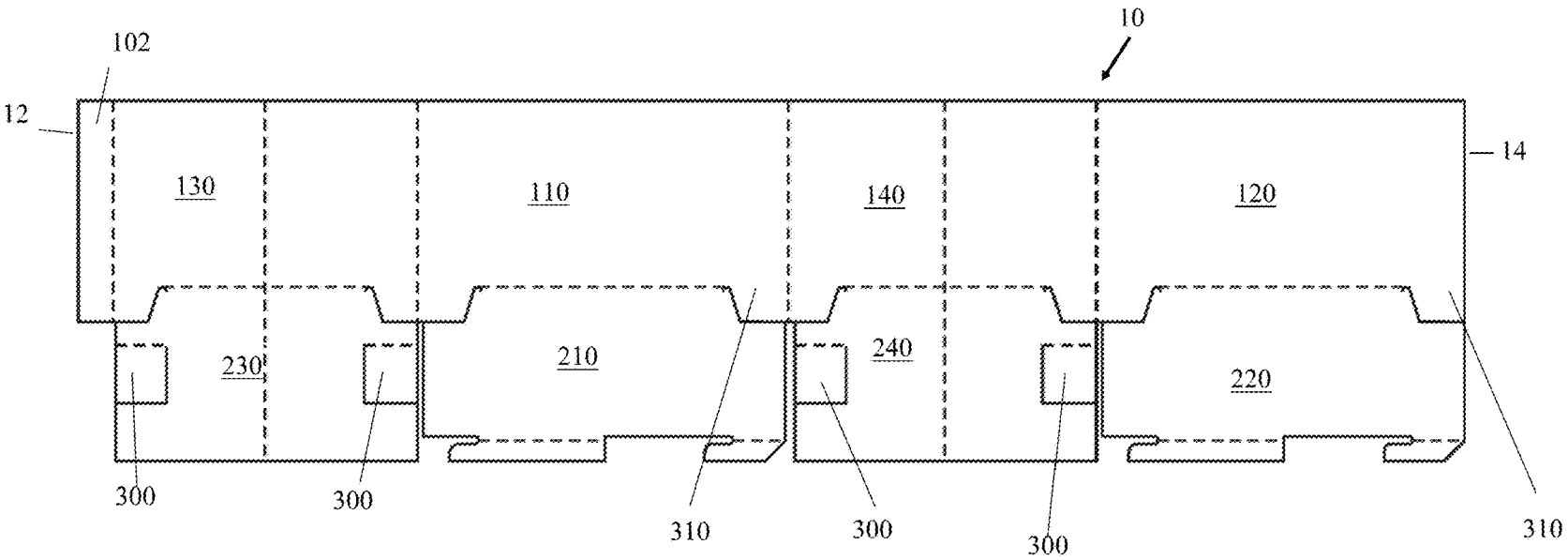
FIG. 5 is a plan view of a die cut and pre-creased and/or perforated flat piece of material in a pattern of a preferred embodiment of the present invention, the flat piece of material being configured so as to be selectively moveable to a three-dimensional container configuration.
Figure 8:
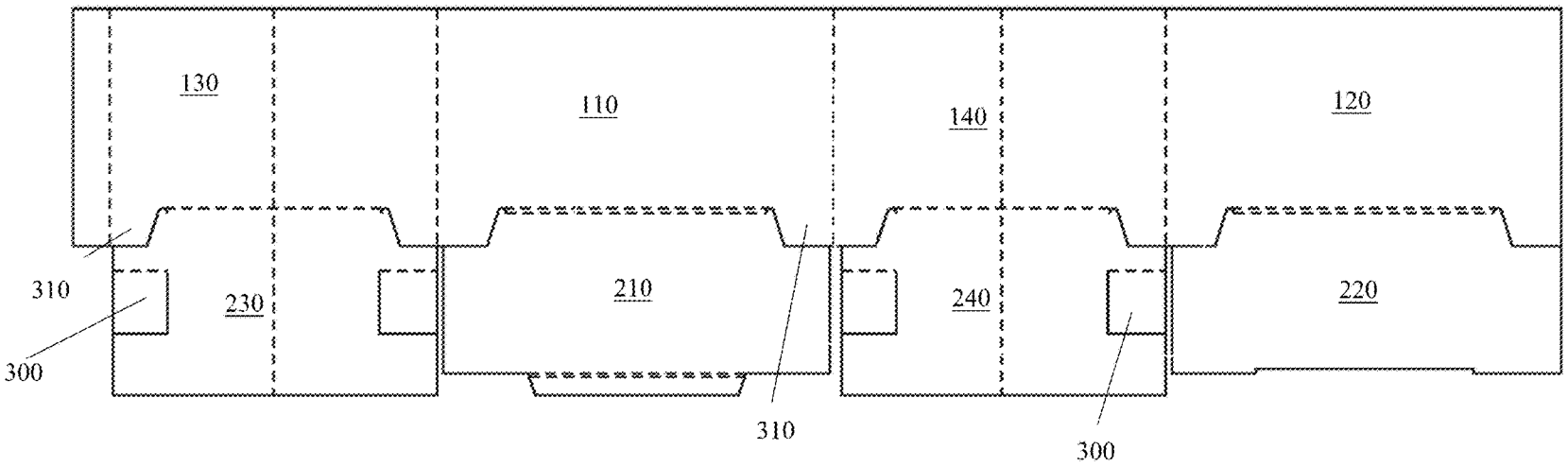
FIG. 8 is a plan view of a die cut and pre-creased and/or perforated flat piece of material in a pattern of a preferred embodiment of the present invention, the flat piece of material being configured so as to be selectively moveable to a three-dimensional container configuration.
Figure 9:
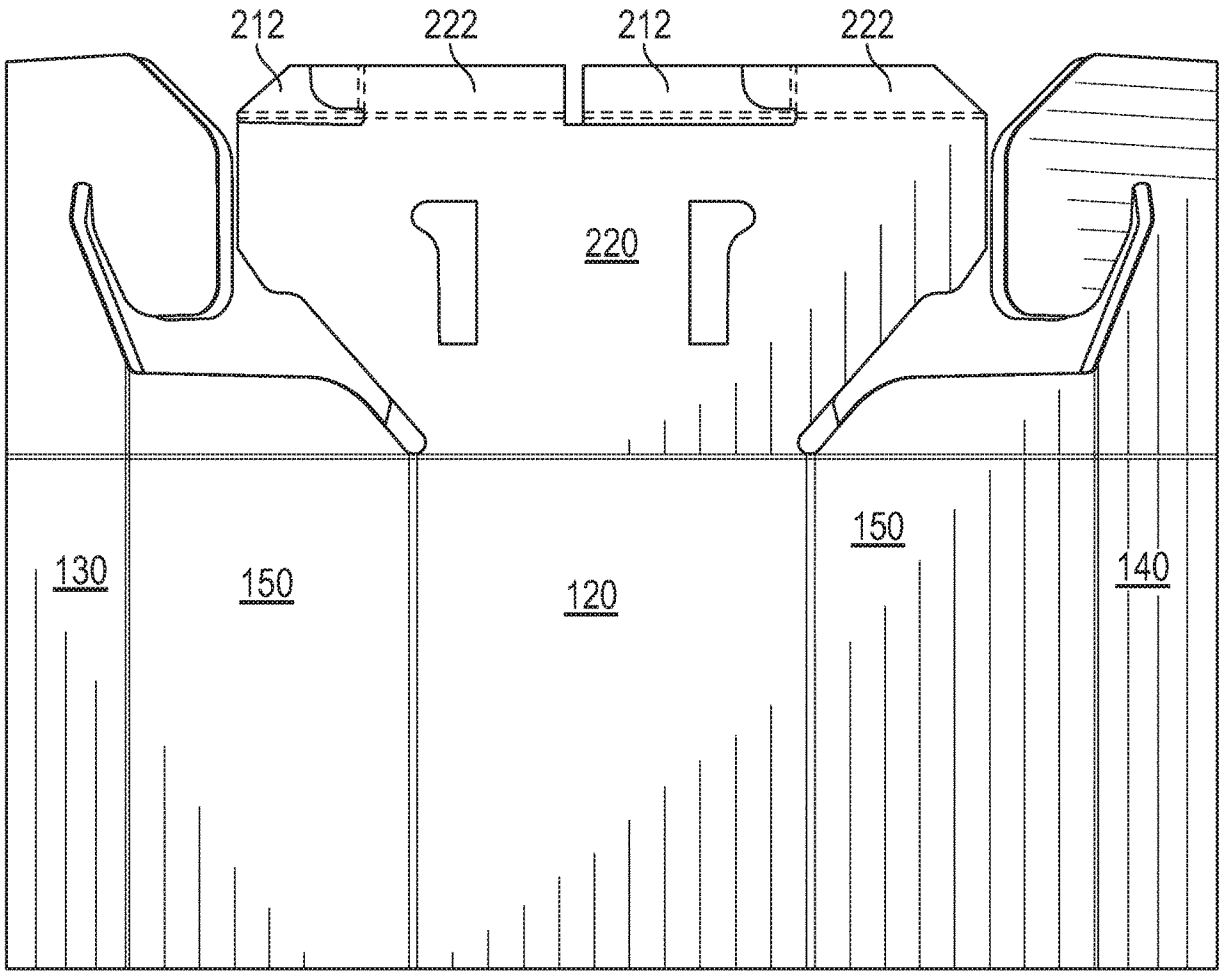
FIG. 9 is a plan view of a container in a stowed configuration prior to the hooks being interlocked.

Referring to FIG. 3, some embodiments of the present invention include corner flaps that fold independent of the end flaps. Referring to FIGS. 5 and 8, other embodiments of the present invention do not include corner flaps or corner panels.

Referring to FIGS. 5 and 8, some embodiments of the present invention include auxiliary flaps 300 that are configured to cover part or all of one or more gap or hole. In some embodiments, one or more auxiliary flap is formed from one or more other panel or flap. Referring to the embodiment shown in FIG. 5, some embodiments of the present invention include legs 310 that are configured to extend around the corners of a pallet, thereby limiting the container's ability to move relative to the pallet. In some such embodiments, the legs are formed at least partially from the bottom flaps and side flaps, thereby creating holes and/or gaps in the bottom surface of the container. In some such embodiments, auxiliary flaps formed from the end flaps are configured to fold over the holes and/or gaps associated with the legs, thereby covering all or part of each hole and/or gap so as to reduce the chance that bulk material will be lost out of the bottom of the container and/or reduce the chance that foreign objects will migrate into the container. In some embodiments, the auxiliary flaps are configured such that the weight of the bulk material prevents the auxiliary flaps from folding away from their respective holes and/or gaps.

The present invention also includes a method of fabricating a flat pattern for a bulk container and folding the bulk container from a flat pattern configuration to a stowed configuration and/or between a stowed configuration and a deployed configuration.

In preferred embodiments, a flat piece of material is die-cut, creased, perforated, and/or otherwise manipulated so as to form a flat pattern configuration of the present invention. In some embodiments, the material is flexible material, such as corrugated paperboard.

In preferred embodiments, the flat pattern configuration includes a first end 112, an opposed second end 114, and a plurality of vertical panels, including first 210 and second 220 side panels, positioned between the opposed first 112 and second 114 ends. In some embodiments, first 210 and second 220 bottom flaps extending from a bottom edge of respective first 110 and second 120 side panels are also formed from the flat piece of material. In some such embodiments, one or more tab 212, 222 extending from a distal end of each bottom flap 210, 220 and a tab finger 214, 224 extending from each tab 212,222 are also formed from the flat piece of material so as to form hooks.

In a preferred embodiment, the vertical panels further include first 130 and second 140 end panels. In some embodiments, first 230 and second 230 end flaps extending from a bottom edge of respective first 130 and second 140 end panels are also formed from the flat piece of material. In some such embodiments, locking tabs 232, 242 coupled to a distal end of each end flap 230, 240 are also formed from the flat piece of material.

In a preferred embodiment, the method includes folding the flat pattern over itself so as to enable the first end 112 of the flat pattern to be secured to the second end 114 of the flat pattern. In some embodiments, each end panel is folded in half and opposed side panels and bottom flaps are stacked on top of each other so as to move the container to a stowed configuration. In some such embodiments, each bottom flap extends away from its respective side panel, allowing the side panels to rest directly against each other. In other such embodiments, each bottom flap is folded up against its respective side panel such that both of the bottom flaps are positioned between the side panels.

In some embodiments, hooks extending from a distal end of each bottom flap are interconnected so as to hingedly couple the distal ends of the bottom flaps to each other. In this way, moving the side panels away from each other towards their respective deployed configuration positions causes the bottom flaps to rotate towards their respective deployed configuration positions. Similarly, moving the side panels towards each other towards their respective stowed configuration positions causes the bottom flaps to rotate towards their respective stowed configuration positions.

In some embodiments, end flaps 230, 240 are folded up against a bottom surface of the bottom flaps when the container is in the deployed configuration. In some such embodiments, the end flaps are secured to the bottom flaps with one or more attaching means, such as adhesive, tape, and/or a locking feature. In some embodiments, locking tabs 232, 242 hingedly coupled to a distal end of each end flap is rotated to an unlocked configuration so that locking tab fingers 236, 246 of the locking tabs can be received by locking slots 216, 226 that are defined by the bottom flaps. In some such embodiments, the locking tabs are then rotated to a locked configuration so as to secure the end flaps to the bottom flaps. In some such embodiments, placing the container on a bottom support structure (such as a floor or a pallet) and/or placing bulk material in the container secures the locking tabs in their respective locked configurations.

In other embodiments, end flaps 230, 240 extending from respective end panels 130, 140 are folded up against an interior surface of their respective end panels prior to interlocking the bottom flap hooks. In some such embodiments, the end flaps are then folded down against a top surface of the bottom flaps when the container is in the deployed configuration. In some such embodiments, auxiliary flaps 300 formed from one or more flap or panel, such as the end flaps, are folded over gaps and/or holes in the bottom flaps, such as those caused by forming legs 310 from the bottom flaps and/or end flaps. In some such embodiments, placing bulk material in the container secures the auxiliary flaps 300 in position over the gaps and/or holes.

Figure 4:
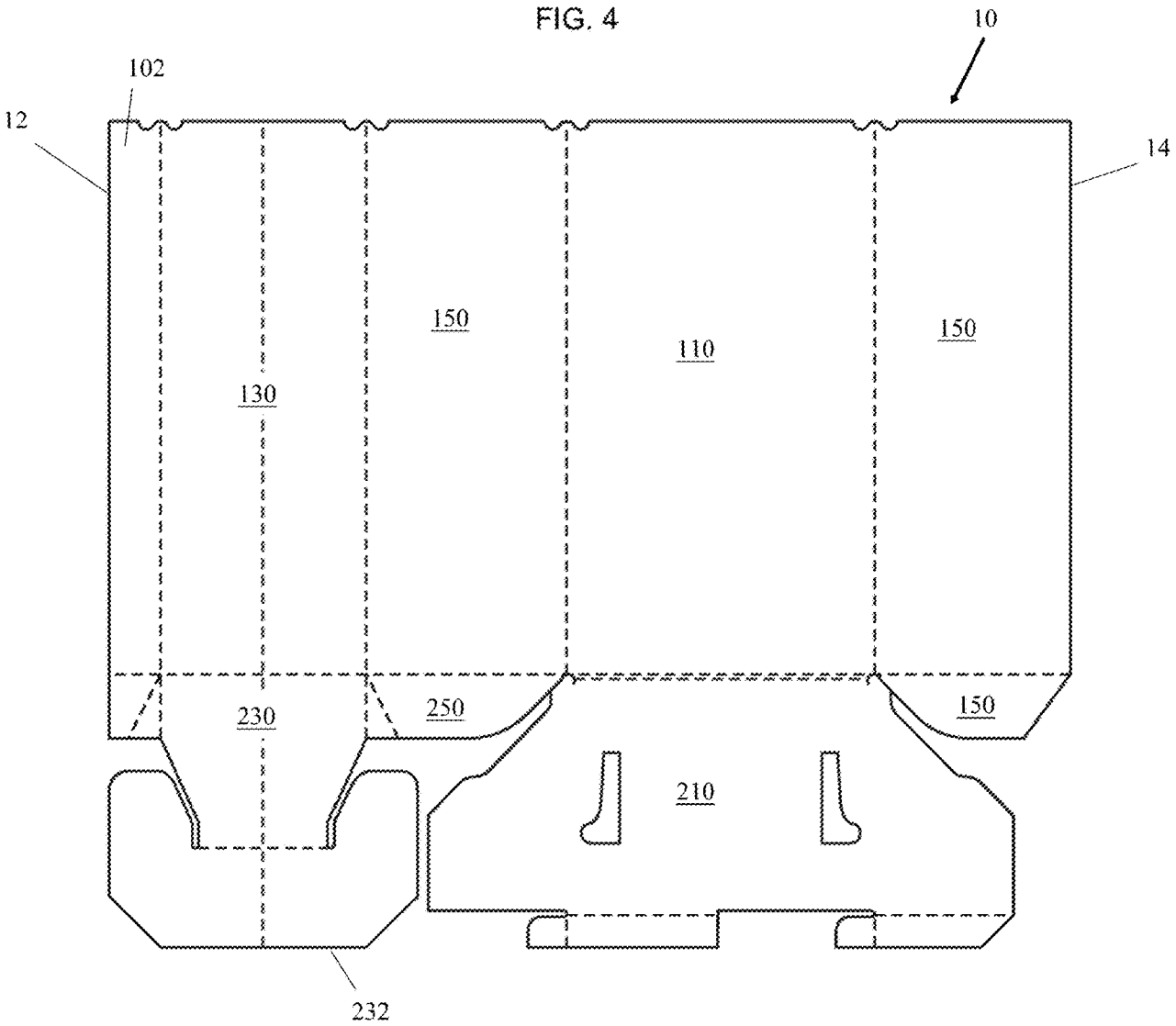
FIG. 4 is a plan view of a first die cut and pre-creased and/or perforated flat piece of material in a pattern of a preferred embodiment of the present invention, the first flat piece of material being configured so as to be selectively coupled to a similar second flat piece of material; together, the first and second flat pieces of material are configured so as to be selectively moveable to a three-dimensional container configuration.
Figure 6:
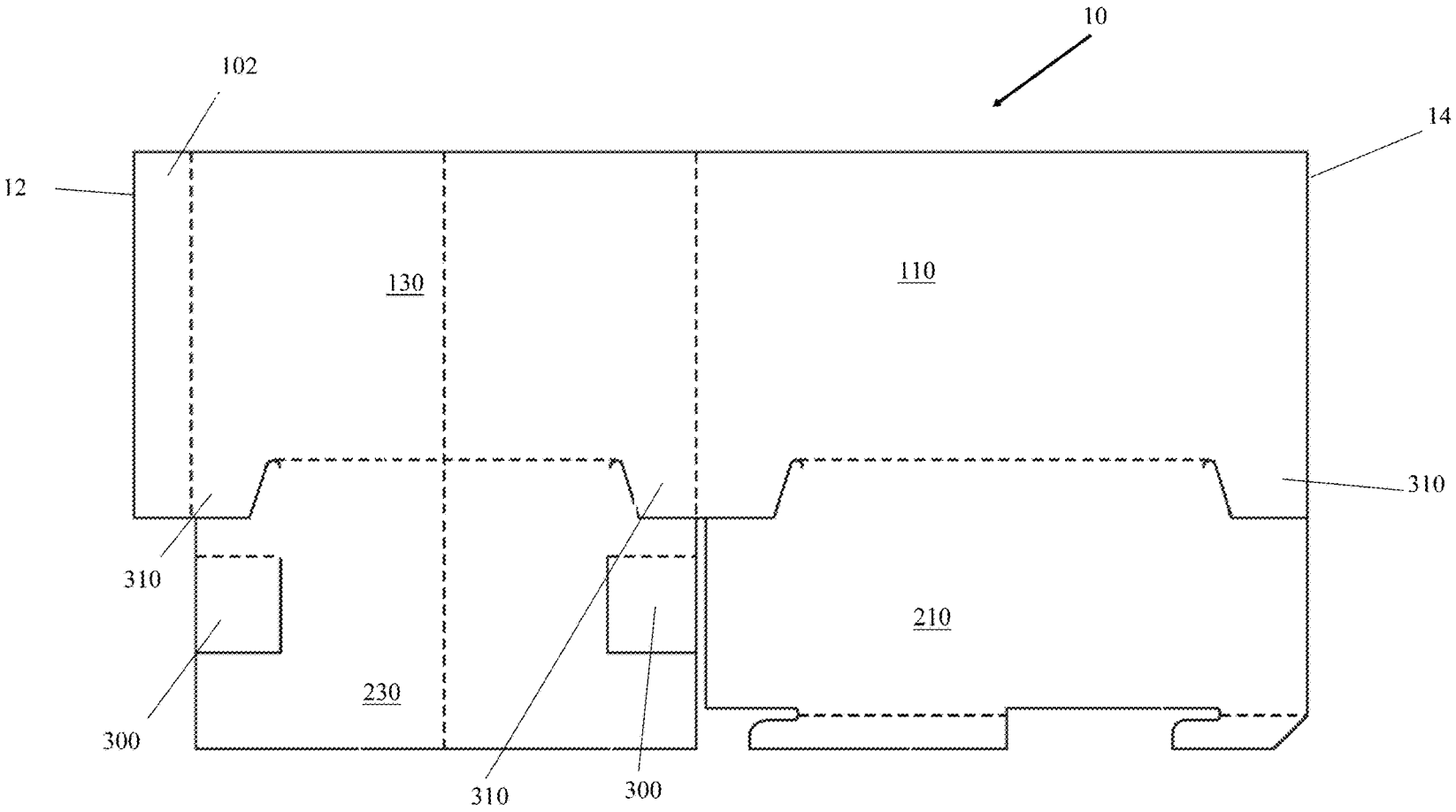
FIG. 6 is a plan view of a first die cut and pre-creased and/or perforated flat piece of material in a pattern of a preferred embodiment of the present invention, the first flat piece of material being configured so as to be selectively coupled to a similar second flat piece of material; together, the first and second flat pieces of material are configured so as to be selectively moveable to a three-dimensional container configuration.
Figure 7B:
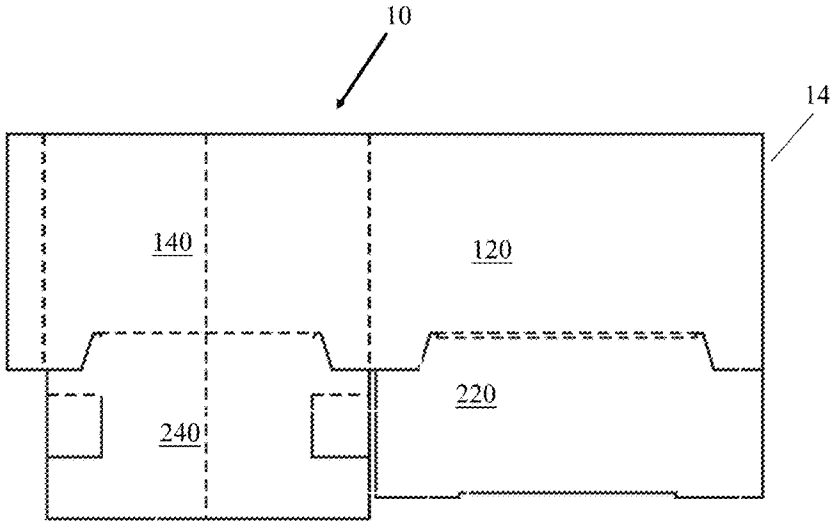
FIG. 7B is a plan view of a second die cut and pre-creased and/or perforated flat piece of material in a pattern of a preferred embodiment of the present invention, the second flat piece of material being configured so as to be selectively coupled to the first flat piece of material of FIG. 7A; together, the first and second flat pieces of material are configured so as to be selectively moveable to a three-dimensional container configuration.
Figure 7A:
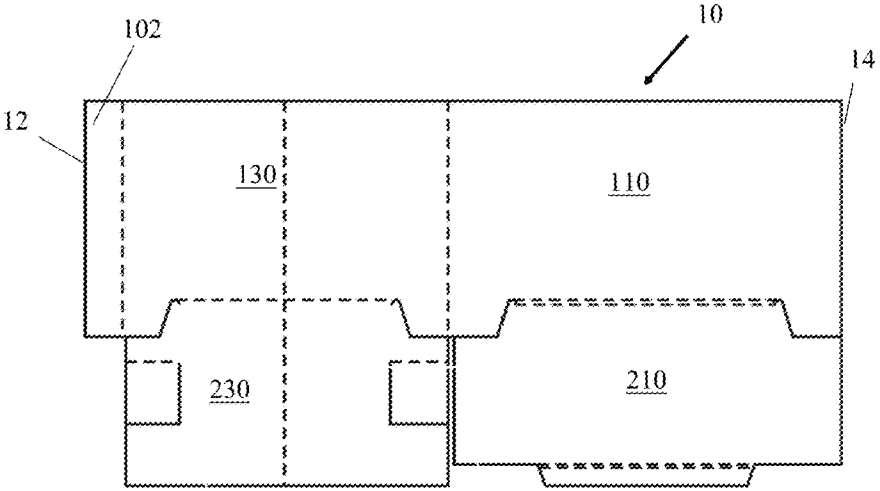
FIG. 7A is a plan view of a first die cut and pre-creased and/or perforated flat piece of material in a pattern of a preferred embodiment of the present invention.

Referring to FIGS. 4, 6, and 7, some embodiments of the present invention are fabricated from two pieces of material. Each piece of material includes first and second ends that are coupled to opposed first or second ends of the other piece of material such that the container can be moved between a stowed configuration and a deployed configuration.

Referring to FIGS. 7 and 8, some embodiments of the present invention do not include interlocking hooks. Instead, such embodiments include other means of securing the distal ends of the opposed bottom flaps to each other. In some such embodiments, the means of securing the distal ends together is one of glue, tape, or some other adhesive means now known or later developed.

Figure 10:
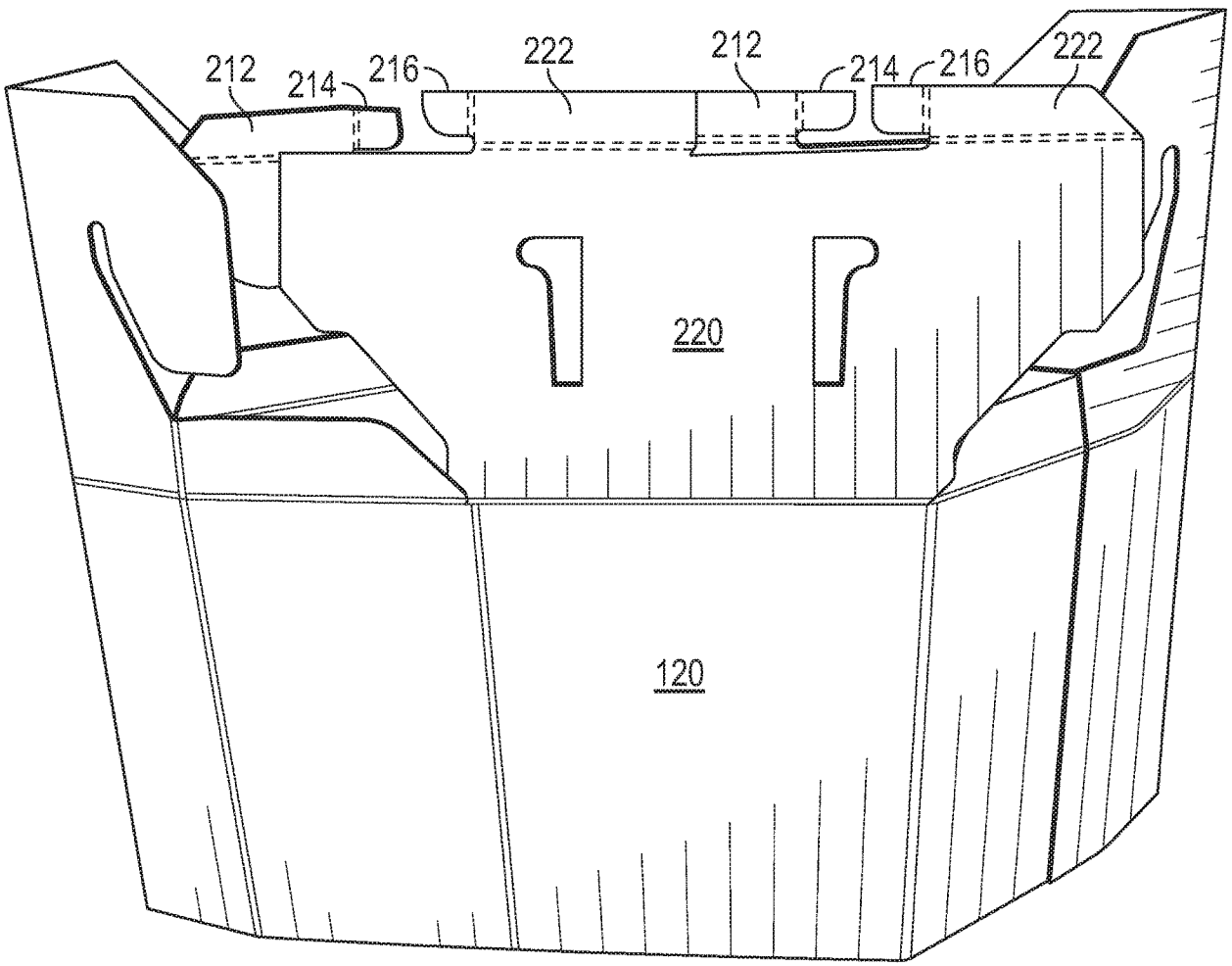
FIG. 10 is a side view of a container of the present invention, the container being oriented upside down and being in a configuration between the stowed and deployed configurations with the bottom flaps being slightly offset from each other so as to enable the hooks to interlock with each other.
Figure 11:
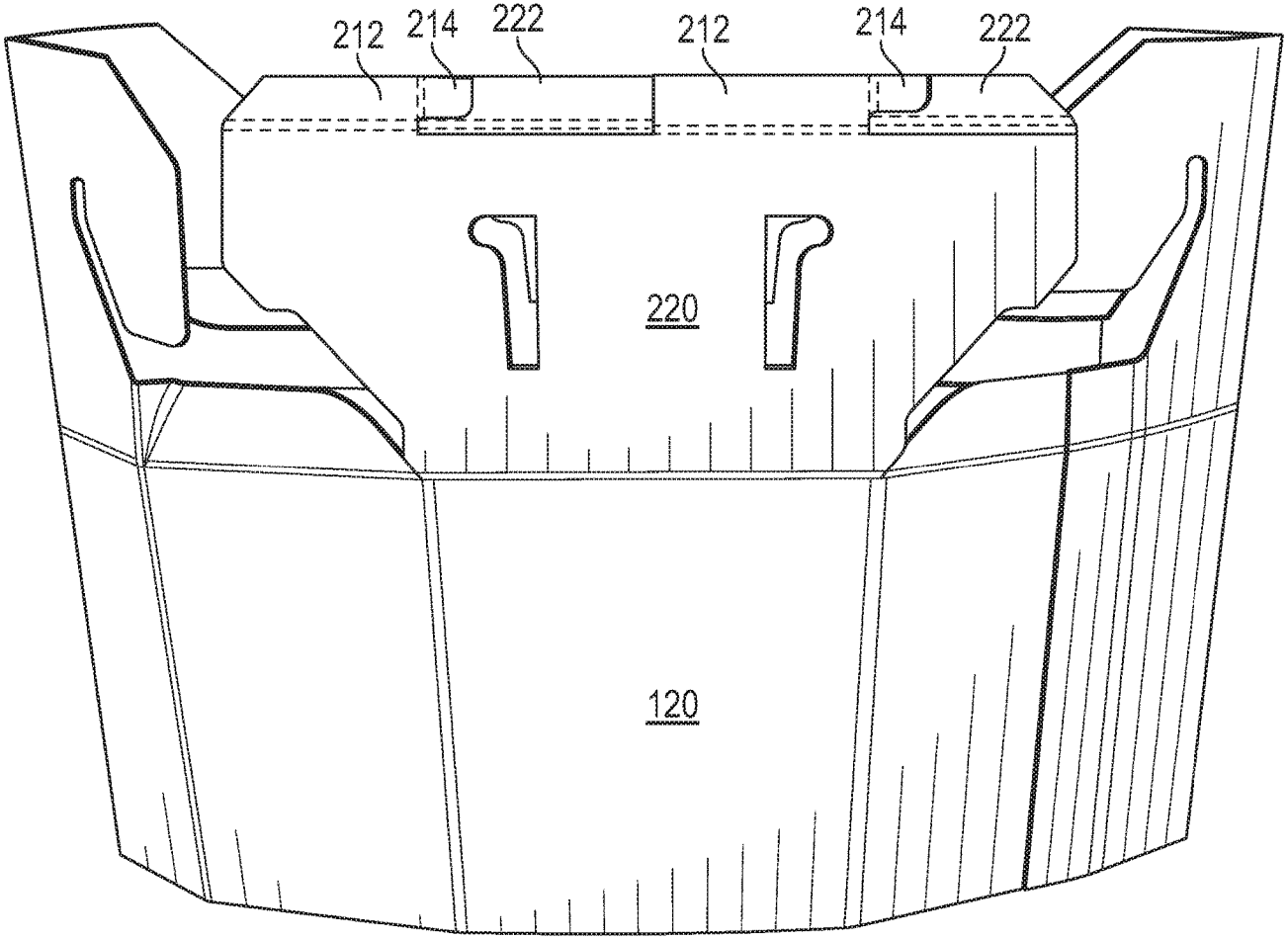
FIG. 11 is the side view of FIG. 10 with the bottom flaps being in alignment with each other and the hooks being interlocked with each other.
Figure 12:
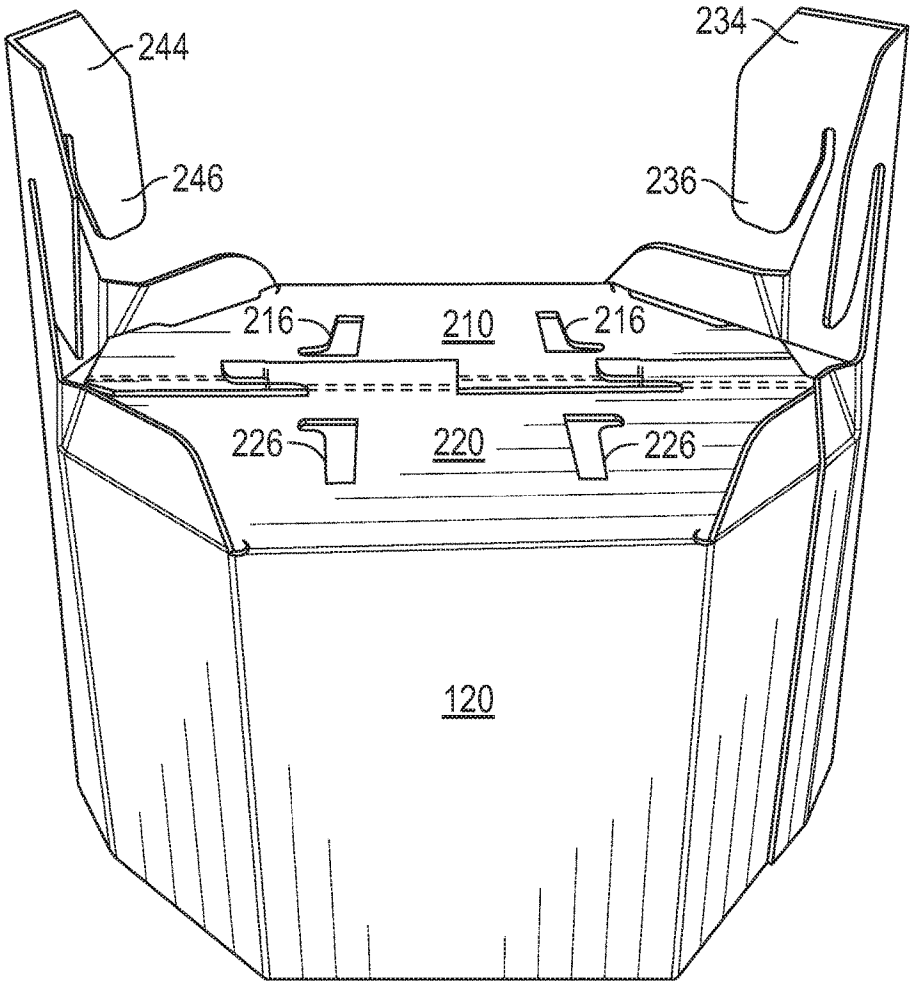
FIG. 12 is a perspective view of a container of the present invention, the container being oriented upside down and being in the deployed configuration with the end flaps being folded away from the bottom flaps.
Figure 13:
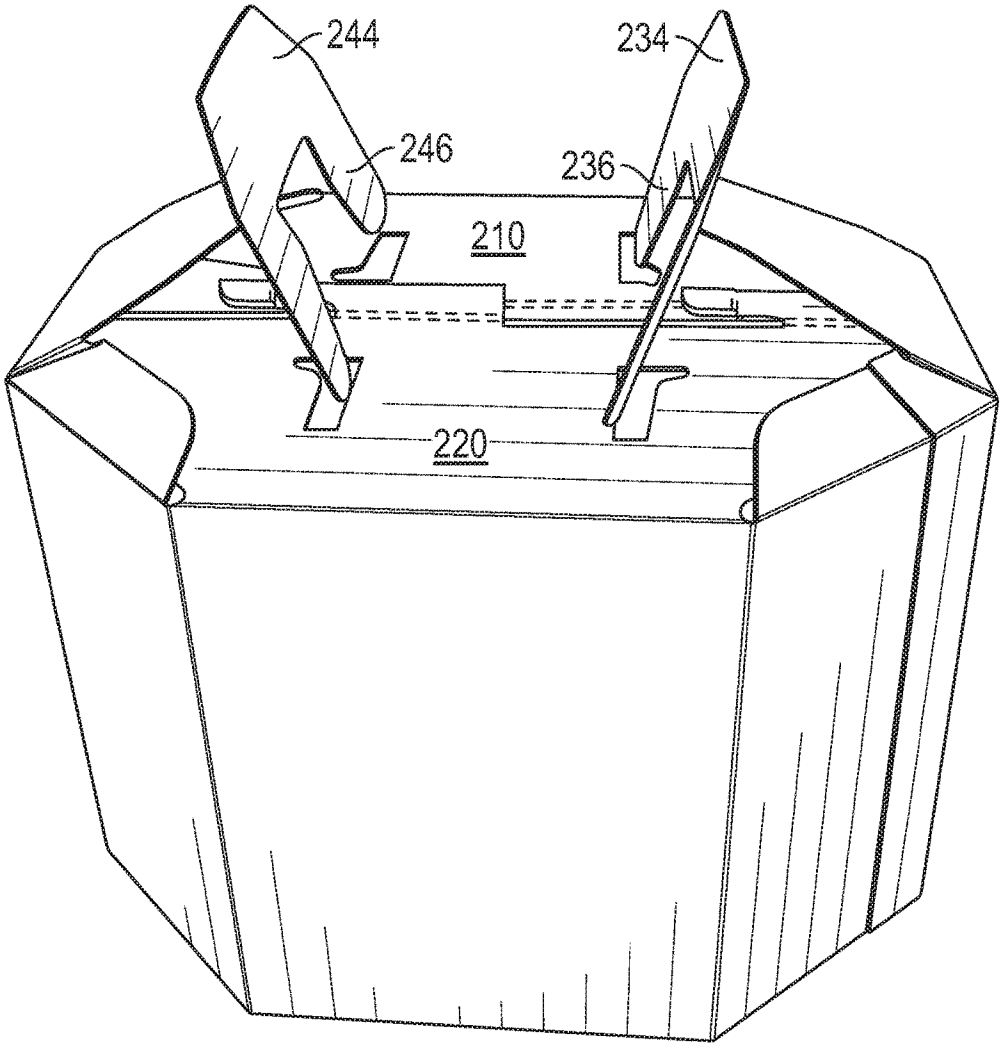
FIG. 13 is the perspective view of FIG. 12 with the locking tabs being in the unlocked configuration and the side flaps being rotated partially towards the bottom flaps.
Figure 14:
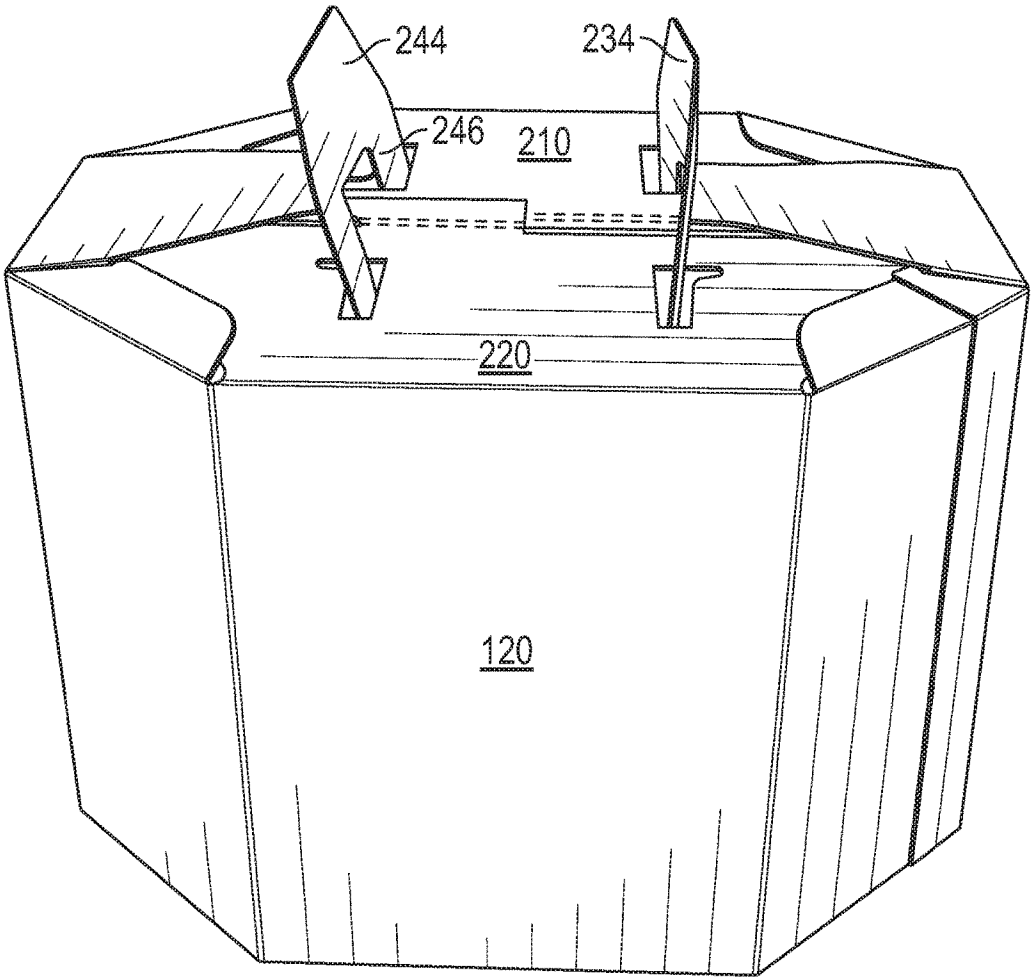
FIG. 14 is the perspective view of FIG. 13 with the locking tab fingers of the locking tabs being received by the locking slots of the bottom flaps.
Figure 15:
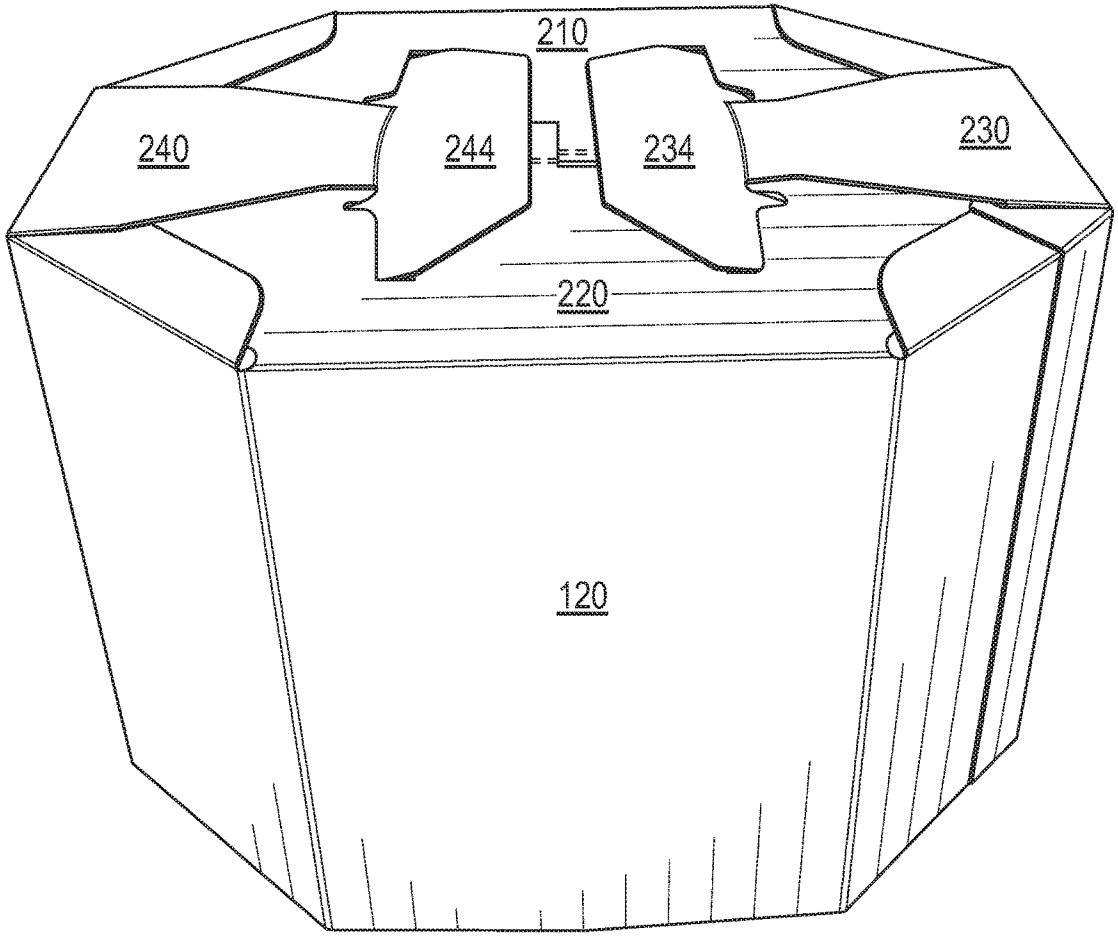
FIG. 15 is a perspective view of a container of the present invention, the container being oriented upside down and being in the deployed configuration with the end flaps being folded against the bottom flaps and the locking tabs being in a locked configuration.

In some embodiments, such as shown in FIGS. 10 and 11, the hooks of the present invention are interlocked by moving the container to a configuration between the stowed and deployed configurations. In some such embodiments, the bottom flaps are manipulated until they are slightly offset from each other such that as the distal end of the first bottom flap is rotated towards the distal end of the second bottom flap, the tab fingers of the first bottom flap are allowed to move past the tab fingers of the second bottom flap. In some such embodiments, the bottom flaps are then manipulated until they are realigned with each other, thereby interlocking the hooks of the first bottom flap with the hooks of the second bottom flap by preventing the tab fingers of the first bottom flap from moving past the tab fingers of the second bottom flap.

Figure 16:
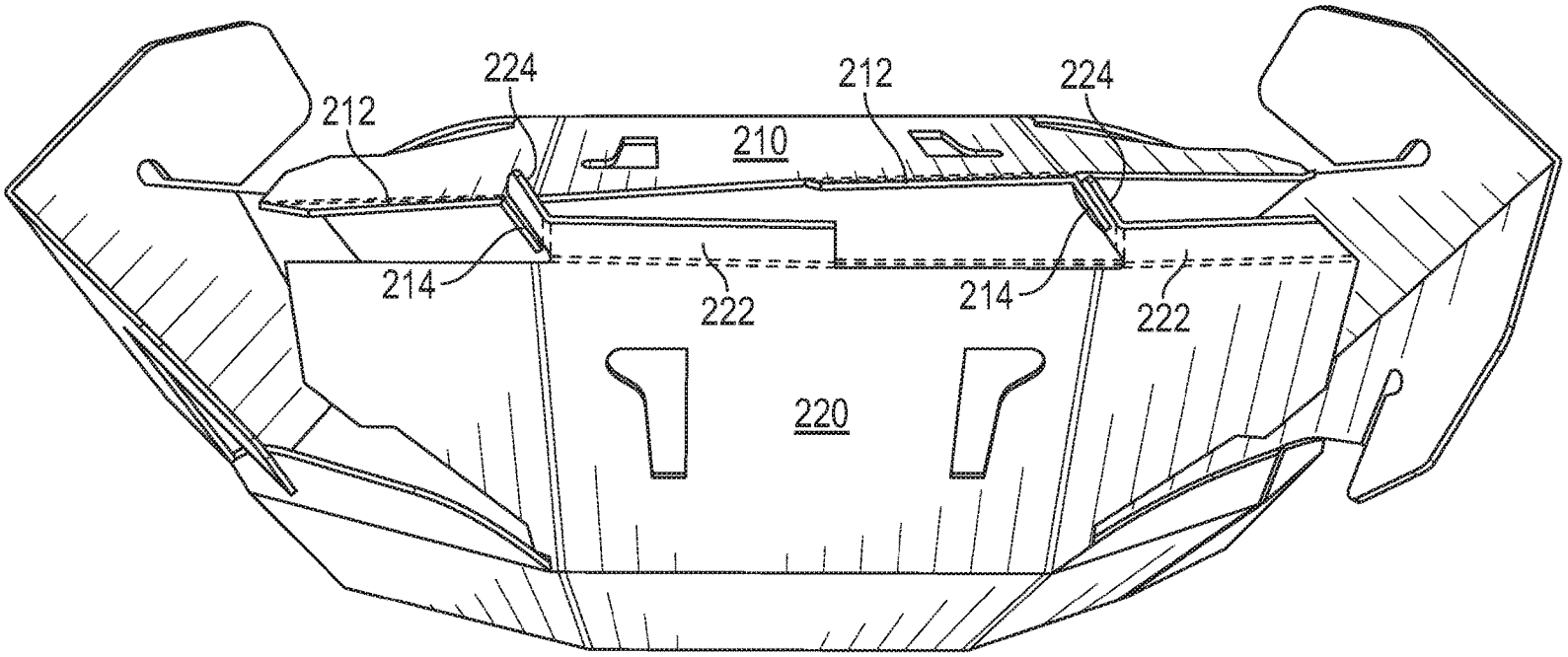
FIG. 16 is a bottom view of a container of the present invention with the tab fingers being folded over so as to enable the hooks to interlock with each other.
Figure 17:
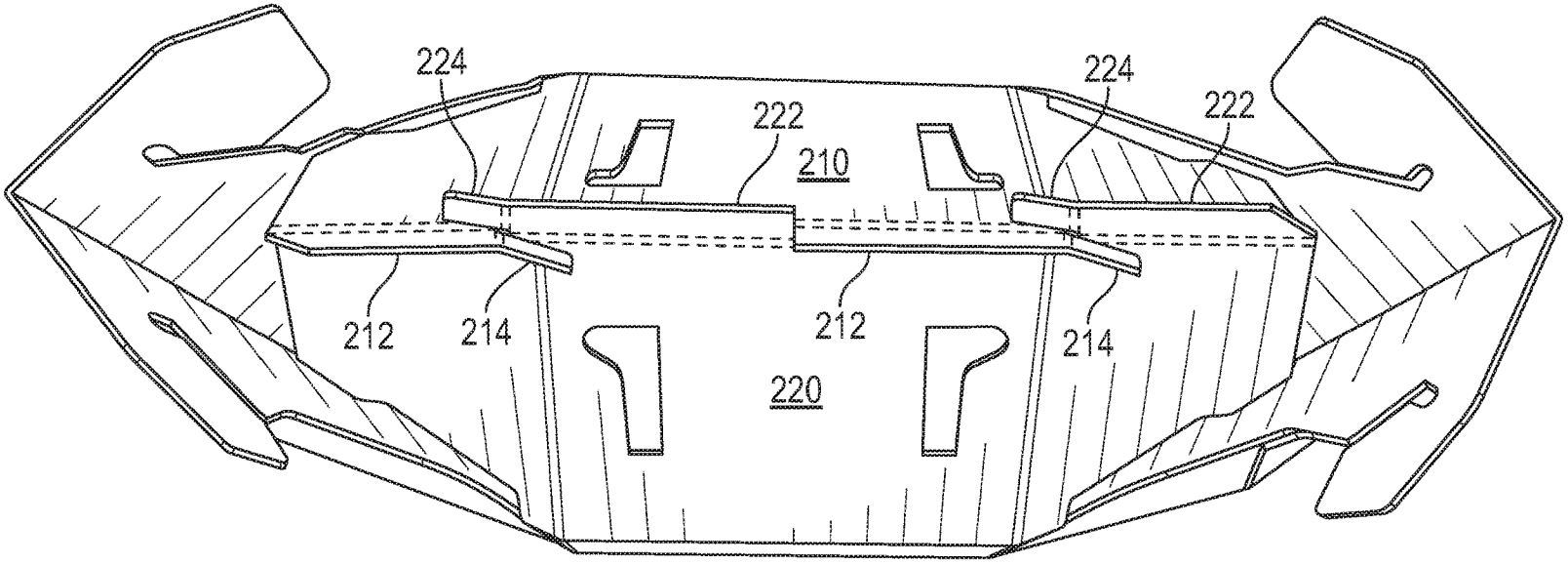
FIG. 17 is the bottom view of FIG. 16 showing the hooks interlocked with each other.
Figure 18:
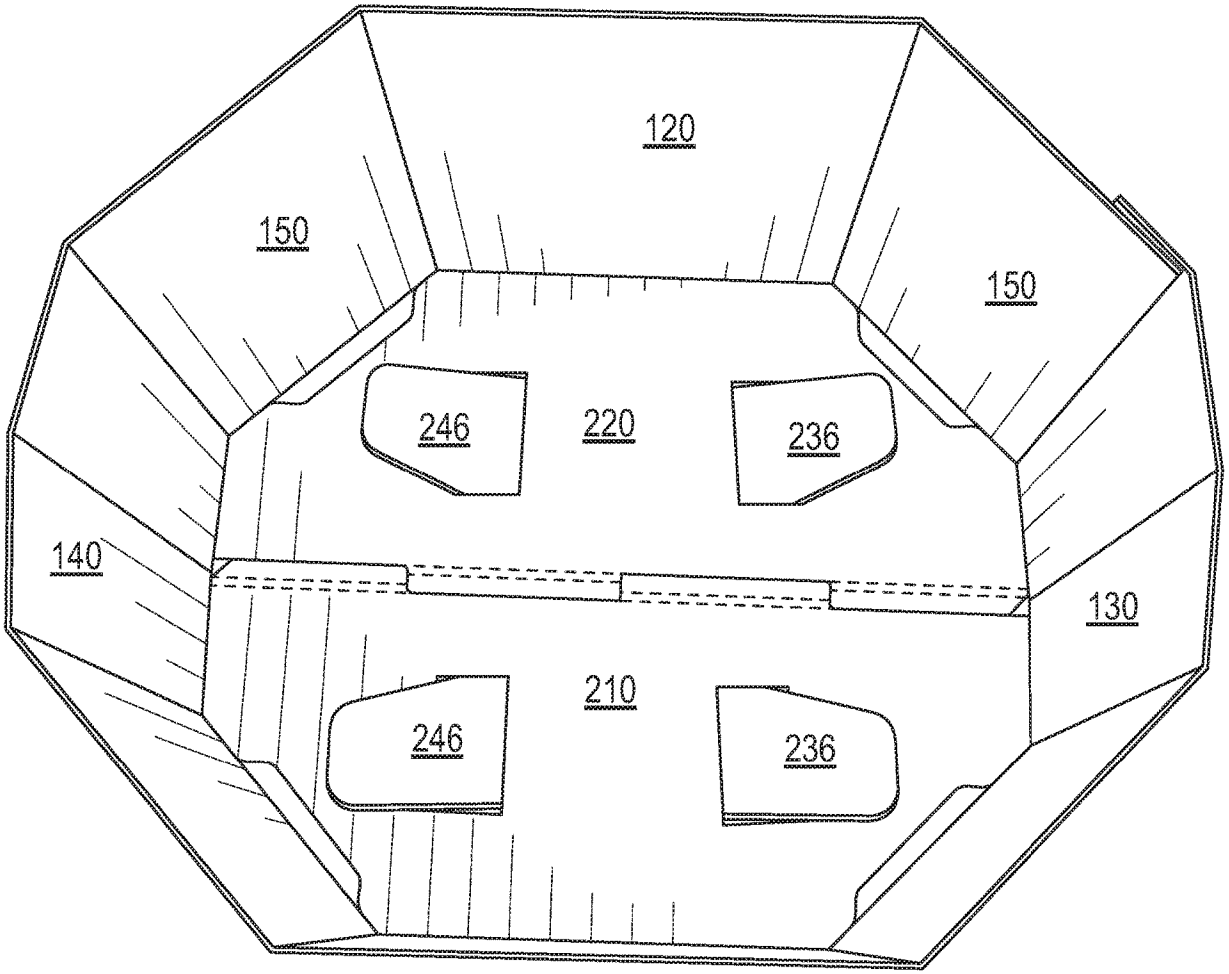
FIG. 18 is a top view of a container of the present invention showing the container in a deployed configuration with locking tab fingers extending into the interior area of the container.

In some embodiments, such as shown in FIGS. 16 and 17, the hooks of the present invention are interlocked by folding each tab finger such that the tab fingers of the first bottom flap are allowed to move past the tab fingers of the second bottom flap. In some such embodiments, the tab fingers are then unfolded so as to prevent the tab fingers of the first bottom flap from moving past the tab fingers of the second bottom flap, thereby interlocking the hooks of the bottom flaps.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A container for holding bulk material, the container comprising:

a plurality of interconnected panels, including opposed first and second side panels and opposed first and second end panels;

opposed first and second bottom flaps extending from respective bottom edges of respective first and second side panels;

opposed first and second end flaps extending from respective bottom edges of respective first and second end panels;

a first locking tab hingedly coupled to a distal end of the first end flap; and a second locking tab hingedly coupled to a distal end of the second end flap, wherein the container is movable between a stowed configuration and a deployed configuration, wherein the first and second bottom flaps are approximately horizontal and the plurality of interconnected panels extend approximately vertically from the first and second bottom flaps when the container is in the deployed configuration such that the plurality of interconnected panels and the first and second bottom flaps, together, define an interior area having a generally enclosed bottom and an open top, and wherein the first and second locking tabs are each moveable between a locked configuration and an unlocked configuration, wherein the first and second locking tabs are configured to secure their respective first and second end flaps to the first and second bottom flaps when the container is in the deployed configuration and the locking tabs are in the locked configuration, wherein rotating the locking tabs to the unlocked configuration when the container is in the deployed configuration enables the end flaps to be rotated away from the bottom flaps, thereby enabling the container to be moved away from the deployed configuration, and wherein each locking tab includes a handle portion that is positioned between a bottom surface of the bottom flaps and a top surface of a support structure when the container is in the deployed configuration and positioned on the support structure.

2. The container of claim 1, further comprising:

a first tab extending from a distal end of the first bottom flap and a first tab finger extending from the first tab so as to define a first hook; and a second tab extending from a distal end of the second bottom flap and a second tab finger extending from the second tab so as to define a second hook, wherein the first and second hook are configured to interlock so as to hinged) couple the distal ends of the first and second bottom flaps to each other.

3. The container of claim 1, wherein the locking tabs include locking tab fingers that are configured to be received by locking slots defined by the bottom flaps when the container is in the deployed configuration.

4. The container of claim 3, wherein the locking tab fingers are positioned within the interior area of the container and are folded relatively flat against a top surface of the bottom flaps when the locking tabs are in the locked configuration such that bulk material positioned in the interior area of the container biases the locking tabs towards their respective locked configurations, thereby inhibiting the locking tabs' ability to move to their respective unlocked configurations.

5. The container of claim 1, wherein the weight of the container inhibits each locking tab's ability to move away from the locked configuration.

6. The container of claim 5, wherein each locking tab is further secured in the locked configuration as weight is added to the container.

7. The container of claim 1, further including a first set of hooks extending from the distal end of the first bottom panel and a second set of hooks extending from the distal end of the second bottom flap, wherein each hook of the first set of hooks is interlocked with a hook of the second set of hooks.

8. The container of claim 7, wherein interlocking the first and second set of hooks together causes the first and second bottom flaps to rotate relative to each other as the container is moved between the deployed configuration and the stowed configuration.

9. The container of claim 7, wherein as the container is moved from the deployed configuration to the stowed configuration, the first and second end panels move between respective folded and unfolded configurations.

10. The container of claim 1, wherein the first and second end panels each define a fold line extending between respective top and bottom edges of respective first and second end panels, wherein the fold lines are configured to provide a controlled bending point when items are placed within the interior area of the container.

11. A method of forming a container for holding bulk material, the method comprising:

cutting a flat piece of material to form a flat pattern, the flat pattern including a first locking tab and a second locking tab;

folding the flat piece of material so as to define a plurality of interconnected panels, including opposed first and second side panels and opposed first and second end panels;

folding the flat piece of material so as to define first and second bottom flaps extending from respective bottom edges of respective first and second side panels; and folding the flat piece of material so as to define first and second end flaps extending from respective bottom edges of respective first and second end panels, wherein the first locking tab extends from a distal end of the first end flap and the second locking tab extends from a distal end of the second end flap, wherein the container is moveable between a stowed configuration and a deployed configuration, wherein the first and second locking tabs are moveable between a locked configuration and an unlocked configuration, wherein the first and second locking tabs are configured to secure their respective first and second end flaps to the first and second bottom flaps when the container is in the deployed configuration and the locking tabs are in the locked configuration wherein rotating the locking tabs to the unlocked configuration when the container is in the deployed configuration enables the end flaps to be rotated away from the bottom flaps, thereby enabling the container to be moved away from the deployed configuration, and wherein each locking tab includes a handle portion that is positioned between a bottom surface of the bottom flaps and a top surface of a support structure when the container is in the deployed configuration and positioned on the support structure.

12. The method of claim 11, wherein the flat pattern includes a first tab and first tab finger defining a first hook extending from a distal end of the first bottom flap and a second tab and second tab finger defining a second hook extending from a distal end of the second bottom flap, the first and second hook being configured to interlock with each other.

13. The method of claim 11, wherein the cutting step further comprises cutting a first and second locking slots from each of the first and second bottom flaps, each locking slot being configured to receive a finger of a respective first or second locking tab.

14. The method of claim 11, wherein the folding step further includes forming a fold line extending between respective top and bottom edges of each of the first and second end panels, wherein the fold lines are configured to provide a controlled bending point when items are placed within the interior area of the container.

15. A method of moving a container for holding bulk material between a stowed configuration and a deployed configuration defining an interior area, the method comprising:

biasing a first side panel away from a second side panel so as to cause opposed first and second end panels to move from a folded configuration to an unfolded configuration, wherein first and second bottom flaps extend from respective bottom edges of respective first and second side panels, wherein first and second end flaps extend from respective bottom edges of respective first and second side panels, wherein a first locking tab extends from a distal end of the first end flap, wherein a second locking tab extends from a distal end of the second end flap, wherein the first and second locking tabs are each moveable between a locked configuration and an unlocked configuration, wherein the first and second locking tabs are configured to secure their respective first and second end flaps to the first and second bottom flaps when the container is in the deployed configuration and the locking tabs are in the locked configuration, wherein rotating the locking tabs to the unlocked configuration when the container is in the deployed configuration enables the end flaps to be rotated away from the bottom flaps, thereby enabling the container to be moved away from the deployed configuration, and wherein each locking tab includes a handle portion that is positioned between a bottom surface of the bottom flaps and a top surface of a support structure when the container is in the deployed configuration and positioned on the support structure.

16. The method of claim 15, wherein first and second sets of hooks extend from respective distal ends of respective first and second bottom flaps, and wherein each hook of the first set of hooks is configured to interlock with a hook of the second set of hooks so as to hingedly couple the distal end of the first bottom flap with the distal end of the second bottom flap.

17. The method of claim 15, further comprising:

rotating each of the first and second locking tabs from a locked configuration to an unlocked configuration when the container is in the deployed configuration; and rotating each of the first and second end flaps away from the first and second bottom flaps, thereby moving the container away from the deployed configuration.

18. The method of claim 15, further comprising:

moving the first and second locking tabs to their respective unlocked configurations;

rotating the first and second end flaps towards the first and second bottom flaps, thereby moving the container towards its deployed configuration; and moving the first and second locking tabs to their respective locked configurations, thereby securing respective first and second end flaps to the first and second bottom flaps.

* * * * *